US007536985B2

(12) United States Patent
Suzuki et al.

(10) Patent No.: US 7,536,985 B2
(45) Date of Patent: May 26, 2009

(54) VALVE TIMING CONTROL DEVICE

(75) Inventors: Shigemitsu Suzuki, Takahama (JP); Naoto Toma, Kariya (JP); Takeshi Hashizume, Handa (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 4 days.

(21) Appl. No.: 11/790,841

(22) Filed: Apr. 27, 2007

(65) Prior Publication Data

US 2007/0261651 A1 Nov. 15, 2007

(30) Foreign Application Priority Data

Apr. 27, 2006 (JP) ..... 2006-123303

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

RE37,268 E * 7/2001 Scheidt et al. ..... 123/90.17
6,871,620 B2 * 3/2005 Aimone ..... 123/90.17
7,357,105 B2 * 4/2008 Moriwaki et al. ..... 123/90.12

FOREIGN PATENT DOCUMENTS

JP 2004-60572 A 2/2004
JP 2006-37886 A 2/2006

* cited by examiner

*Primary Examiner*—Zelalem Eshete
(74) *Attorney, Agent, or Firm*—Buchanan Ingersoll & Rooney PC

(57) ABSTRACT

A valve opening and closing timing control device includes a phase control unit having a drive side rotation member for rotating in synchronization with a crankshaft of an internal combustion engine, a driven side rotation member provided coaxially with the drive side rotation member for rotating in synchronization with a camshaft of the engine and a phase control mechanism for controlling a relative rotational phase between the drive side member and the driven side member by being supplied with an operation fluid. The phase control unit is provided at each set of camshafts of the internal combustion engine having plurality sets of camshafts. The valve timing control device further includes a first pump driven by the internal combustion engine and a second pump driven by a motor, wherein the first pump supplies the operation fluid to all of the phase control units provided at the each set of camshafts and the second pump supplies the operation fluid only to the phase control unit provided at one set of camshaft.

10 Claims, 10 Drawing Sheets

VALVE TIMING CONTROL DEVICE

This application is based on and claims priority under 35 U.S.C. §119 to Japanese Patent Application 2006-123303, filed on Apr. 27, 2006, the entire content of which is incorporated herein by reference.

FIELD OF THE INVENTION

The present invention relates to a valve opening and closing timing control device and more particularly to a valve opening and closing timing control device for an internal combustion engine of a vehicle provided with a phase control unit at each camshaft set and the phase control unit of the valve timing control device includes a drive side rotation member rotating synchronized with a crankshaft of the engine, a driven side rotation member arranged coaxially with the drive side rotation member and rotating synchronized with a camshaft of the engine and a phase control mechanism for controlling a relative phase position between the drive side and driven side rotation members based on a supply of operation fluid.

BACKGROUND

Conventionally, a valve timing control device is known, which can achieve a proper driving condition in response to a rotation speed of the crankshaft by adjusting the opening/closing timing of the intake valves and the exhaust valves of the internal combustion engine. The valve timing control device of such conventional structure is disclosed in a Japanese Patent Publication 2006-037886A (particularly in FIG. 1 and pages 5 and 6 in the specification). The disclosed valve timing control device includes a phase control unit having a drive side rotation member rotating in synchronization with the crankshaft, a driven side rotation member arranged coaxially with the drive side rotation member and rotating in synchronization with the camshaft and a hydraulic chamber formed between the drive side and the driven side rotation members and divided into an advance angle chamber and a retard angle chamber by a vane. The phase control unit is formed at an end portion of the camshaft for unitary rotation therewith. The valve timing control device further includes a hydraulic circuit for supplying the operation fluid to the hydraulic chamber of the phase control unit. The valve opening or closing timing of the intake and exhaust valves of the internal combustion engine is controlled to an advanced angle side or a retarded angle side by the supply of the operation fluid to one of or both of the advance angle chamber and the retard angle chamber from the hydraulic circuit.

One of such hydraulic circuit is disclosed in Japanese Patent Publication 2004-060572A (particularly in FIG. 1 and pages 4 and 5 of the specification). This structure is illustrated in FIG. 12 of the drawing attached to this application. The valve timing control device according to FIG. 12 includes a phase control unit 101 which changes the rotation phase of the camshaft relative to the rotation of the crankshaft of the internal combustion engine by using the hydraulic pressure of the operation fluid to adjust opening/closing timing of the valves driven by the camshaft, a mechanical pump 102 driven by rotation of the crankshaft for supplying the operation fluid to the phase control unit 101, a hydraulic circuit 103 for valve operating system hydraulically connecting the phase control unit 101 and the mechanical pump 102, a hydraulic circuit 105 for cylinder block system branched from the hydraulic circuit 103 for the valve operating system for supplying the operation fluid into a cylinder block portion 104, a filter device 106 provided in the hydraulic circuit 103 for filtering operation of the operation fluid discharged from the mechanical pump 102 and an electric pump 107 provided in the hydraulic circuit 103 between the phase control unit 101 and the filter device 106 and driven by a motor.

The mechanical pump 102 and the electric pump 107 are arranged in series and the electric motor 107 is positioned at downstream of the filter device 106. Accordingly, any foreign material or object may be prevented from entering into the electric pump 107. The mechanical pump 102 is driven in correlation with the engine rotation speed (rpm), and accordingly, operation fluid may be insufficient when the engine rotation speed is low. However, according to this structure, the electric pump 107 is actuated when the engine rotation speed is low to compensate for the insufficient supply of the operation fluid.

In the engine with V-type or horizontally oppositely placed type (Boxer type), each set of camshaft is supported respectively in each bank of the engine block. One or two camshafts usually form a set of camshaft. In more detail, SOHC (Single Over Head Camshaft) type engine has only one camshaft and DOHC (Double Over Head Camshaft) engine has two camshafts. The engine type having a plurality of banks includes a phase control unit at a set of camshaft. Accordingly, each phase control unit is separately arranged with each other according to the distance between each set of camshafts.

Since the plurality of phase control units is separately positioned, the operation fluid supply circuit between the electric pump and the phase control unit has to be branched off in plural because of the position situation. The total length of the conduit from the electric pump to each phase control unit has to be elongated and it is necessary to use a high power electric pump to effectively function against a large flow resistance in the conduit generated especially when the temperature of the fluid is low and the viscosity of the fluid is high. Also, if the length of the conduit is long, it takes a relatively longer time to fill the operation fluid in the empty conduit when the engine is started.

On the other hand, a plurality of electric pumps can be arranged corresponding to the number of the phase control units to dispose the electric pumps close to the units. The length of the conduit from the electric pump to the phase control unit becomes shorter and the power of the electric pump can be reduced to prevent a slow operation of the phase control unit due to the hitherto use of a large powered electric pump. However, the number of the electric pump is increased which may lead to the cost increase of the total system and the consumption of the electricity becomes large.

Accordingly, it is an object of the invention to provide a valve opening and closing timing control device having a prompt operation of the phase control device at the start of the engine and to reduce the cost of manufacturing and less consumption of the energy.

SUMMARY OF THE INVENTION

According to one aspect of the invention, the valve opening and closing timing control device for a vehicle includes a phase control unit provided at each set of plurality sets of camshafts and the phase control unit having a drive side rotation member rotating synchronization with a crankshaft of an engine, a driven side rotation member arranged in coaxial with the drive side rotation member, a phase control mechanism for controlling a relative rotational phase between the drive side rotation member and the driven side rotation member upon receipt of the operation fluid. The valve timing control device further includes a first pump driven by the engine and a second pump driven by a motor. The first pump supplies the operation fluid to all phase control units provided at each set of camshafts, whereas the second pump supplies the operation fluid to the phase control unit provided at a particular one set of camshafts.

BRIEF DESCRIPTION OF THE DRAWINGS

The foregoing and additional features and characteristics of the present invention will become more apparent from the following detailed description considered with reference to the accompanying drawings, wherein.

F*ig*. 12 is a schematic view of a conventional valve timing control device.

1. Engine Structure

Figure 2:
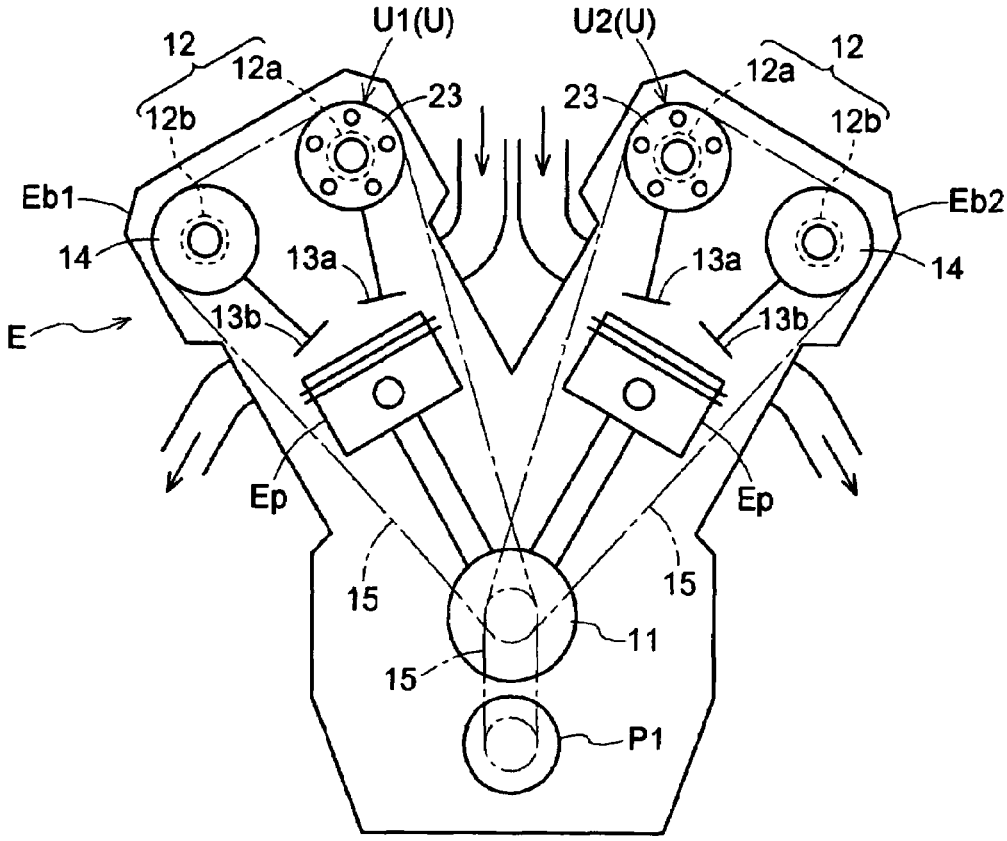
FIG. 2 is a schematic view of a phase control unit U and the first pump arrangement according to the valve timing control device of the invention.

First, engine E to which the valve opening and closing timing control device of the invention is applied will be explained. The engine illustrated in FIG. 2 shows a V-type engine having two banks Eb1 and Eb2 in which the engine cylinders (not shown) are housed. Piston Ep is housed in each cylinder. The engine type is DOHC and in each bank Eb1 and Eb2, an intake side camshaft 12*a* for controlling the opening/closing of the intake valves 13*a* and a exhaust side camshaft 12*b* for controlling the opening/closing of the exhaust valves 13*b*. In this embodiment, there are two camshafts, one for opening/closing intake valve and the other for opening/closing exhaust valve in each bank to form a set 12 of camshafts (12*a* and 12*b*) in each bank Eb1 and Eb2. Accordingly, the number of set of camshafts in this embodiment is two (one set in the bank Eb1 and the other set in the bank Eb2).

A phase control unit U is fixed to each one end of the intake side camshafts 12*a*. The phase control unit U includes a timing sprocket 23 which will be explained later in detail. A normal type-timing sprocket 14 is fixed to each one end of the exhaust side camshafts 12*b*. The intake side and the exhaust side camshafts 12*a* and 12*b* are connected to a crankshaft 11 via a drive force transmitting member such as a timing chain or timing belt 15 which is wound around the timing sprockets 14 and 23 for synchronizing rotation with the rotation of crankshaft 11. A first pump P1 is also connected to the crankshaft 11 via the drive force-transmitting member 15 for synchronizing rotation with the rotation of crankshaft 11.

In FIG. 2, the two banks Eb1 and Eb2 and the intake valves 13*a* and exhaust valves 13*b* are shown on the same plane, however, actually these are arranged in different positions in an axial direction of the crankshaft 11. Two pistons Ep, Ep are illustrated in FIG. 2, but further pistons and the same number of cylinders are arranged in axial direction of the crankshaft 11 depending on the capacity of the engine.

2. Overall Outline of Valve Opening and Closing Timing Control of the Valve Timing Control Device 1 According to the Invention The valve timing control device 1 will be explained hereinafter. In FIG. 2, the phase control units U are provided only at the intake side camshafts 12*a* of the engine E and are not provided at the exhaust side camshafts 12*b*. Accordingly, the valve timing control device 1 controls the rotational phase of the intake side camshafts 12*a* relative to the rotation of the crankshaft 11 by displacing either towards advance angle side or the retard angle side or maintaining or holding the phase to any desired position relative to the crankshaft 11. The phase control unit U includes two units, a first phase control unit U1 provided at the left side bank Eb1 as viewed in FIG. 2 and a second phase control unit U2 provided at the right side bank Eb2 of the engine block.

Figure 1:
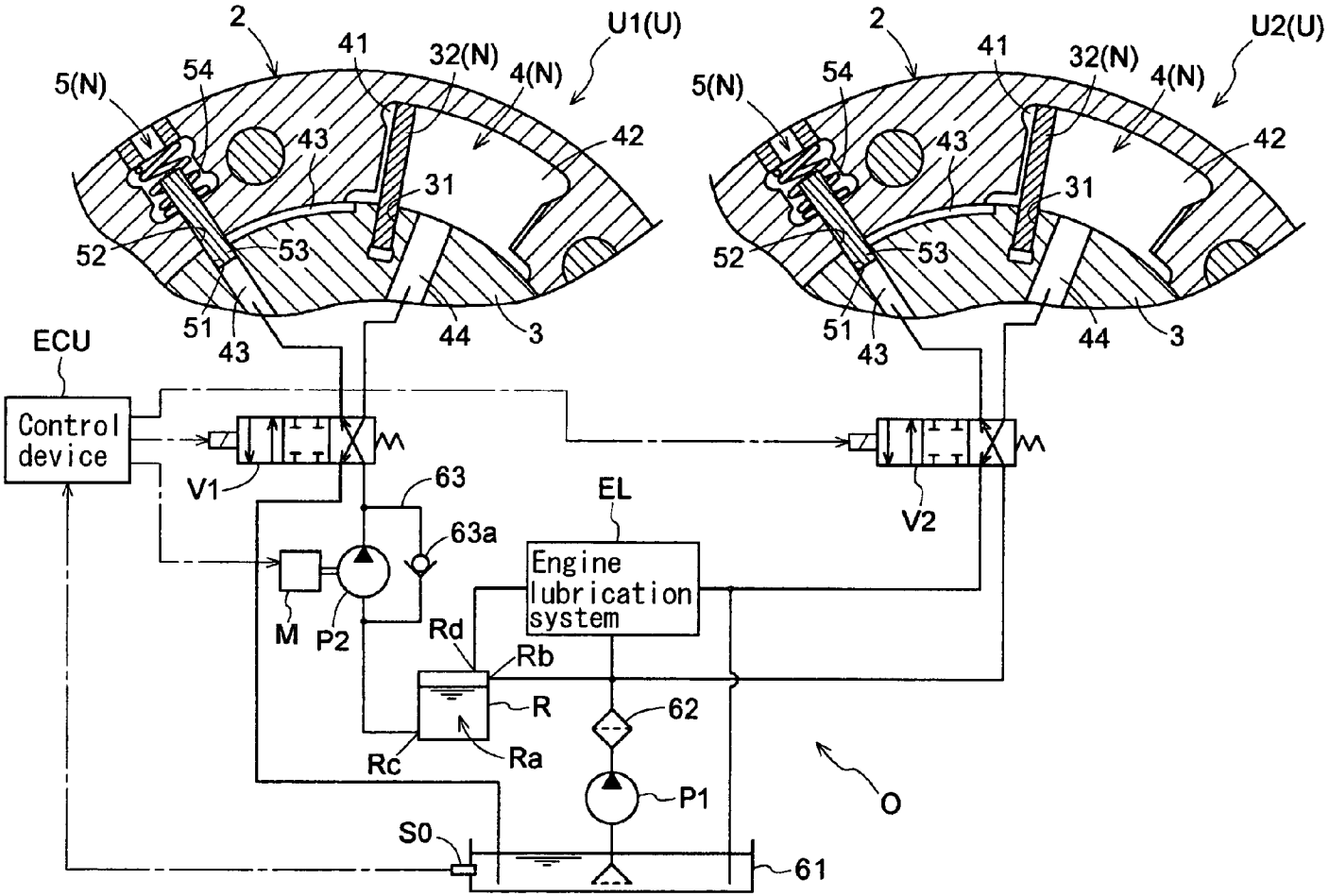
FIG. 1 is a schematic view of a valve timing control device showing the entire structure thereof according to one embodiment of the present invention.

As shown in FIG. 1, the valve timing control device 1 includes the phase control unit U for controlling the relative rotational phase between the intake side camshafts 12*a* and the crankshaft 11 and a hydraulic circuit O for supplying the operation fluid to the phase control unit U. The phase control unit U, particularly shown in FIG. 4 and FIG. 5, includes an outer rotor 2 for synchronizing rotation with the crankshaft 11 of the engine E, an inner rotor 3 arranged coaxially with the outer rotor 2 and synchronizing rotation with the camshaft 12*a* and a phase control mechanism N for controlling the relative rotational phase between the outer rotor 2 and the inner rotor 3 upon receipt of the operation fluid. The phase control mechanism N includes a hydraulic chamber 4, the inner structure components of the chamber (such as vane 32 etc.) and a lock mechanism 5.

Further, the hydraulic circuit O as shown in FIG. 1 includes a first pump P1 driven by the engine E, a second pump P2 driven by a motor M, a reservoir tank R for reserving operation fluid for the second pump P2, a first control valve V1 for controlling supply of operation fluid to the first phase control unit U1 and a second control valve V2 for controlling supply of operation fluid to the second phase control unit U2. The first pump P1 is designed to supply the operation fluid to any of the first and second phase control units U1 and U2, namely to the phase control unit U. On the other hand, the second pump P2 is designed to supply the operation fluid only to one of the first and the second phase control units U1 and U2. In this embodiment, the operation fluid is supplied only to the first phase control unit U1 provided at the intake side camshaft 12*a* of the left side bank Eb1.

Figure 3:
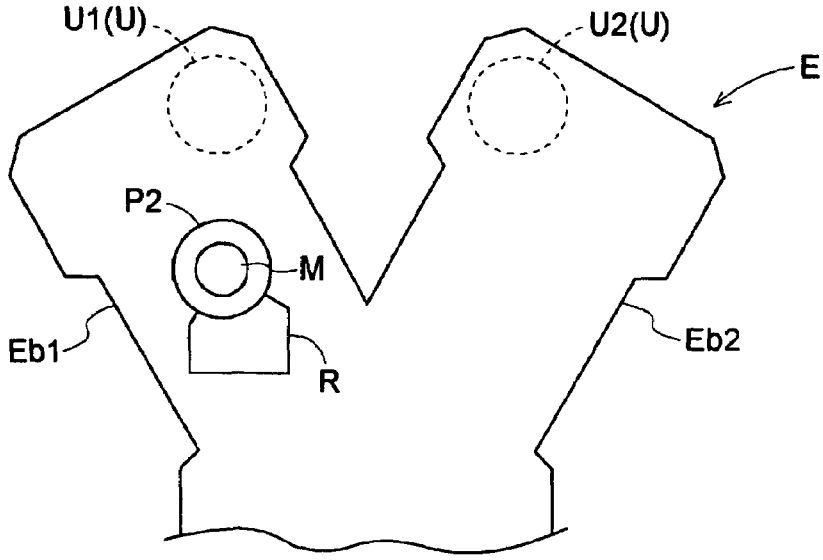
FIG. 3 is a schematic view of a second pump arrangement and a reservoir tank arrangement according to the valve timing control device of the invention.

As shown in FIG. 3, the second pump P2 and the reservoir tank R for the second pump P2 are located at the vicinity of the first phase control unit U1. In more detail, the second pump P2, the motor M and the reservoir tank R for the second pump P2 are located at the engine cylinder wall around the cylinder block and cylinder head of the left side bank Eb1, where the first phase control unit U1 is located. The length of the hydraulic circuit between the first phase control unit U1 and the second pump P2 and between the second pump P2 and the reservoir tank R can be shortened due to the location relationship thereof. Thus the flow resistance of the operation fluid discharged from the second pump P2 can be set to be small to reduce the size of the pump P2 and the motor M. The operations of the second pump P2, the first control valve V1 and the second control valve V2 are controlled by the signals from a control device ECU. The detail of the hydraulic circuit O and the phase control unit U will be explained hereinafter.

3. Phase Control Unit U

The phase control unit U is illustrated in FIG. 4 and FIGS. 5 to 8. The unit U includes the outer rotor 2 rotating synchronizing with the crankshaft 11 of the engine E, the inner rotor 3 disposed coaxially with the outer rotor 2 and rotating synchronizing with the intake side camshaft 12*a* and the phase control mechanism N operated for controlling the relative rotational phase between the outer and the inner rotors 2, 3 upon receipt of the operation fluid. The outer rotor 2 is located at the drive side (a drive side rotation member) and the inner rotor 3 is located at the driven side (a driven side rotation member).

The inner rotor 3 is integrally assembled to the end of the intake side camshaft 12*a*. The intake side camshaft 12*a* is disposed between the cylinder head and head cover portions in each bank Eb1 and Eb2 of the engine block.

Figure 4:
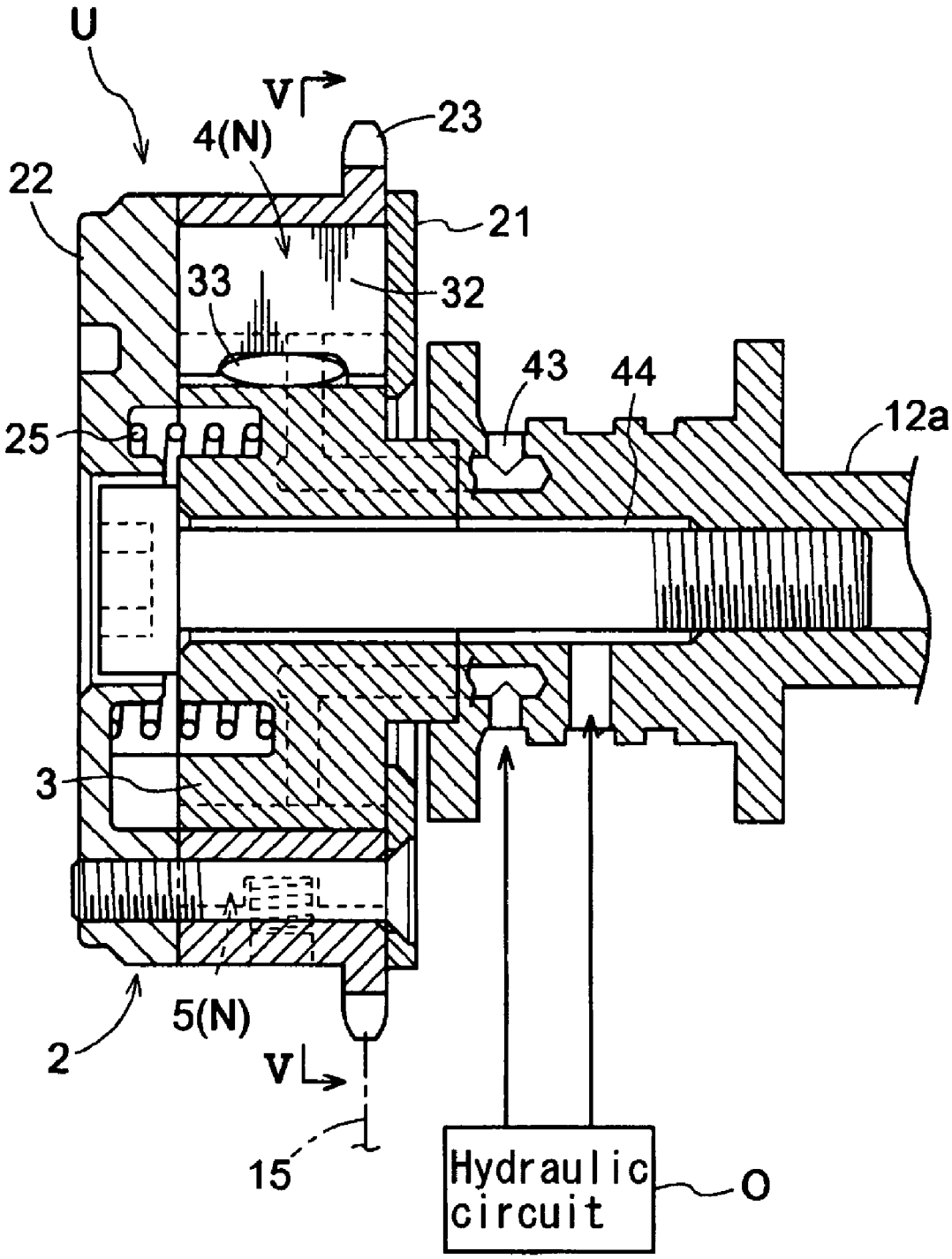
FIG. 4 is a side cross sectional view of the phase control unit of the valve timing control device according to the invention.

The outer rotor 2 is inserted into the inner rotor 3 and relatively rotatable within a predetermined angle range. A rear plate 21 is integrally connected to the outer rotor 2 at one side where the intake side camshaft 12*a* is to be connected and a front plate 22 is integrally connected to the outer rotor 2 at the opposite side to the location of the rear plate 21. Both rear and front plates 21 and 22 are integrally connected to the outer rotor 2 by means of a screw as shown in FIG. 4. A timing sprocket 23 is formed at the outer periphery of the outer rotor 2. The power transmitting member 15, such as timing chain or timing belt is engaged with the timing sprocket 23 for transmitting torque from the crankshaft 11 to the camshaft 12 as shown in FIG. 2.

Figure 5:
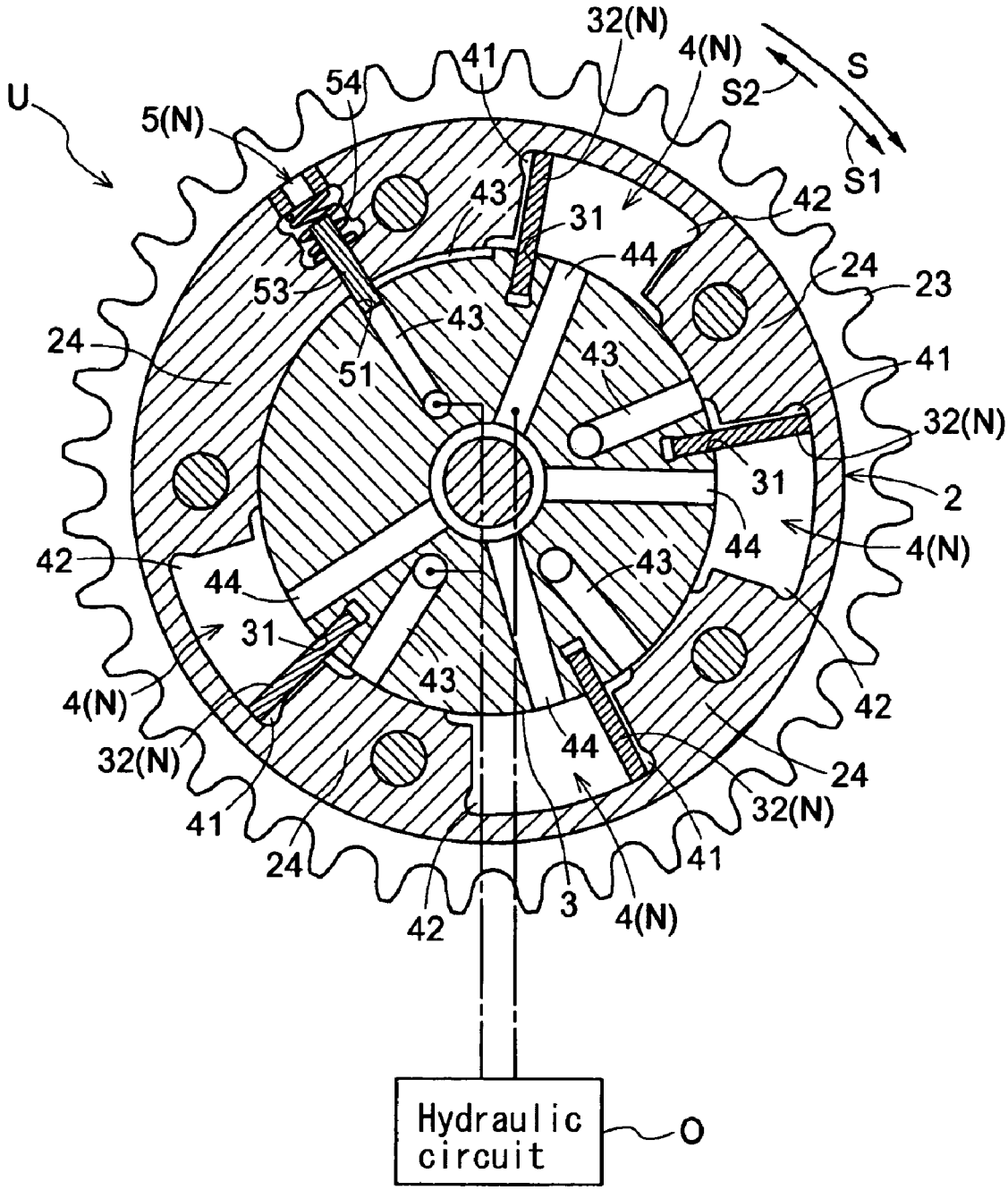
FIG. 5 is cross sectional view taken along the line V-V of FIG. 4.

When the crankshaft 11 is rotated, the rotational torque is transmitted to the timing sprocket 23 through the belt or chain 15. The outer rotor 2 is then rotated in an arrowed direction S as shown in FIG. 5. The inner rotor 3 is also rotated in the arrowed direction S to rotate the intake side camshaft 12*a*. The cam portion of the intake side camshaft 12*a* pushes down to open the intake valve 13*a* (FIG. 2). Similarly, when the crankshaft 11 is rotated, the rotational torque is transmitted to the exhaust side camshaft 12*b* to open the exhaust valve 13*b*.

As shown in FIG. 5, a plurality of inward projections 24 is provided on the outer rotor 2 projecting inwardly in a radial direction with a distance separated with each other. The radial projections 24 function as a shoe for guiding the inner rotor 3. A hydraulic chamber 4 is provided between each projection 24 and is defined by the inner and outer rotors 3 and 2. The number of chamber is four in this embodiment in FIG. 5. The hydraulic chambers 4, internal structure thereof such as vane 32 and the lock mechanism 5 form the phase control mechanism N which controls the relative rotational phases between the two rotors 3 and 2.

A vane groove 31 is provided at the outer periphery of the inner rotor 3 at a portion facing each hydraulic chamber 4. In each vane groove, a vane 32 is slidably inserted in a radial direction. Each vane defines the hydraulic chamber 4 to two chambers, an advance angle chamber 41 and a retard angle chamber 42 in a relative rotational direction (an arrowed direction S1 or S2 in FIG. 5). Each vane 32 is urged outwardly in a radial direction by a spring 33 as shown in FIG. 4.

The advance angle chamber 41 is in communication with an advance angle passage 43 formed in the inner rotor 3, while the retard angle chamber 42 is in communication with a retard angle passage 44. The advance angle passage 43 and the retard angle passage 44 are connected to the hydraulic circuit O as shown in FIG. 5. As shown in the drawing, the advance angle passage 43 of one of the four advance angle chambers 41 located adjacent to the lock mechanism 5 forms a flow path communicating with the advance angle chamber 41 via an engagement recess portion 51 of the lock mechanism 5. In other words, the advance angle passage 43 communicates with the advance angle chamber 41 via the hydraulic circuit O, engagement recess portion 51 and a flow path formed by a sliding surface of the inner rotor 3 relative to the outer rotor 2. The operation fluid ejected from the first pump P1 or the second pump P2 is supplied to or discharged from the advance angle chamber 41 or the retard angle chamber 42 or both chambers via the control valves V1 and V2. The relative rotation phase between the inner rotor 3 and the outer rotor 2 is displaced either in the advance direction S1 (vane 32 moves in the arrowed direction S1) or the retard direction S2 (vane 32 moves in the arrowed direction S2) or the relative rotation phase is held at a certain phase relationship by the urging force. In this embodiment, the movable range of the vane 32 in the hydraulic chamber 4 determines the displaceable relative phase angle, i.e., between the most advanced angle and the most retarded angle.

As shown in FIG. 4, a torsion spring 25 is provided between the front plate 22 and the inner rotor 3. A supporting portion provided at the inner rotor 3 supports one end of the torsion spring 25 and the other end is supported by a supporting portion provided at the front plate 22. This spring 25 always urges the inner and outer rotors 3 and 2 in an advance angle direction S1.

The lock mechanism 5 is provided between the outer rotor 2 and the inner rotor 3 for restraining the displacement of relative rotation therebetween at a predetermined lock phase. The lock phase is set to be the allowable most retarded angle phase position. The lock mechanism 5 includes a lock member 53 slidably provided in a sliding groove 52 formed in the outer rotor 2, a spring 54 for urging the lock member 53 inwardly in a radial direction and the engagement recess portion 51 provided in the inner rotor 3 and engageable with the lock member 53 when the relative rotational phase is in the lock phase position. In this embodiment, the lock member 53 is of a flat plate shape and the sliding groove 52 and the engagement recess portion 51 are shaped accordingly to achieve the locking function. The shapes of these members can be changeable as long as the locking function can be achieved.

Figure 6:
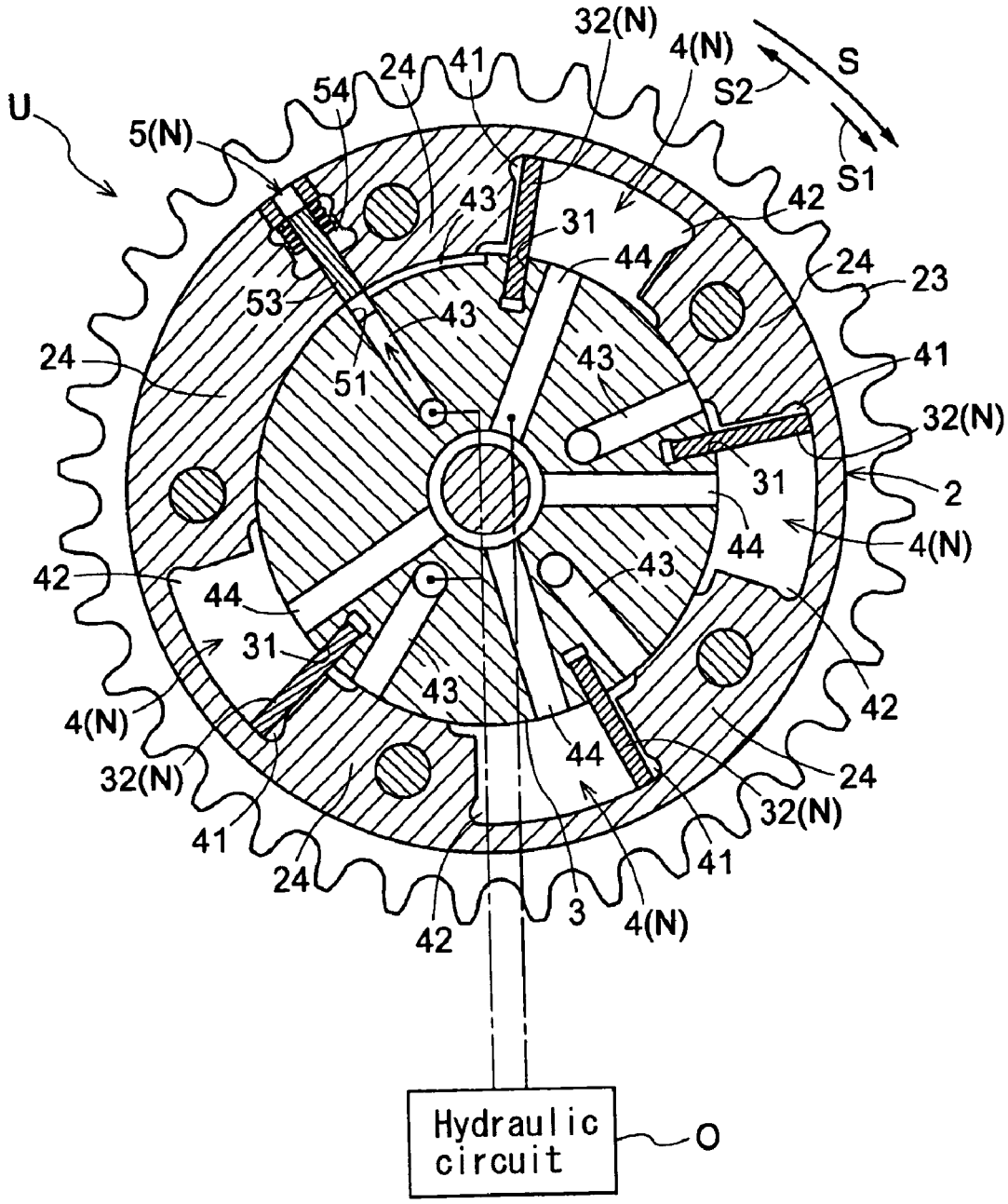
FIG. 6 is similar to FIG. 5, but showing another condition of the phase control unit U.

The engagement recess portion 51 is provided at the inner rotor 3 and radial inner end of the lock member 53 can be engaged with the recess portion 51. The engagement recess portion 51 is provided at a position where the lock member 52 is engaged under the relative rotation phase being at the lock phase position. The lock member 53 is moved into the engagement recess portion 51 by the urging force of the spring 54 to lock the relative rotation between the inner rotor 3 and the outer rotor 2. Thus the relative rotation is restrained to the lock phase position. The engagement recess portion 51 is in communication with the advance angle passage 43 and the operation fluid from the hydraulic circuit O is supplied to the advance angle passage 43 to force the lock member 53 to be retracted from the engagement recess portion 51 to release the locking condition. In other words, the engagement recess portion 51 is filled with the operation fluid to generate the hydraulic pressure therein to move the lock member 53 from the engagement recess portion 51 by overcoming the spring force of the spring 54 as shown in FIG. 6. The inner and outer rotors are now relatively rotatable to allow the relative displacement. When the operation fluid is discharged from the engagement recess portion 51, the lock member 53 is moved into engagement recess portion 51 by the force of the spring 54.

Figure 7:
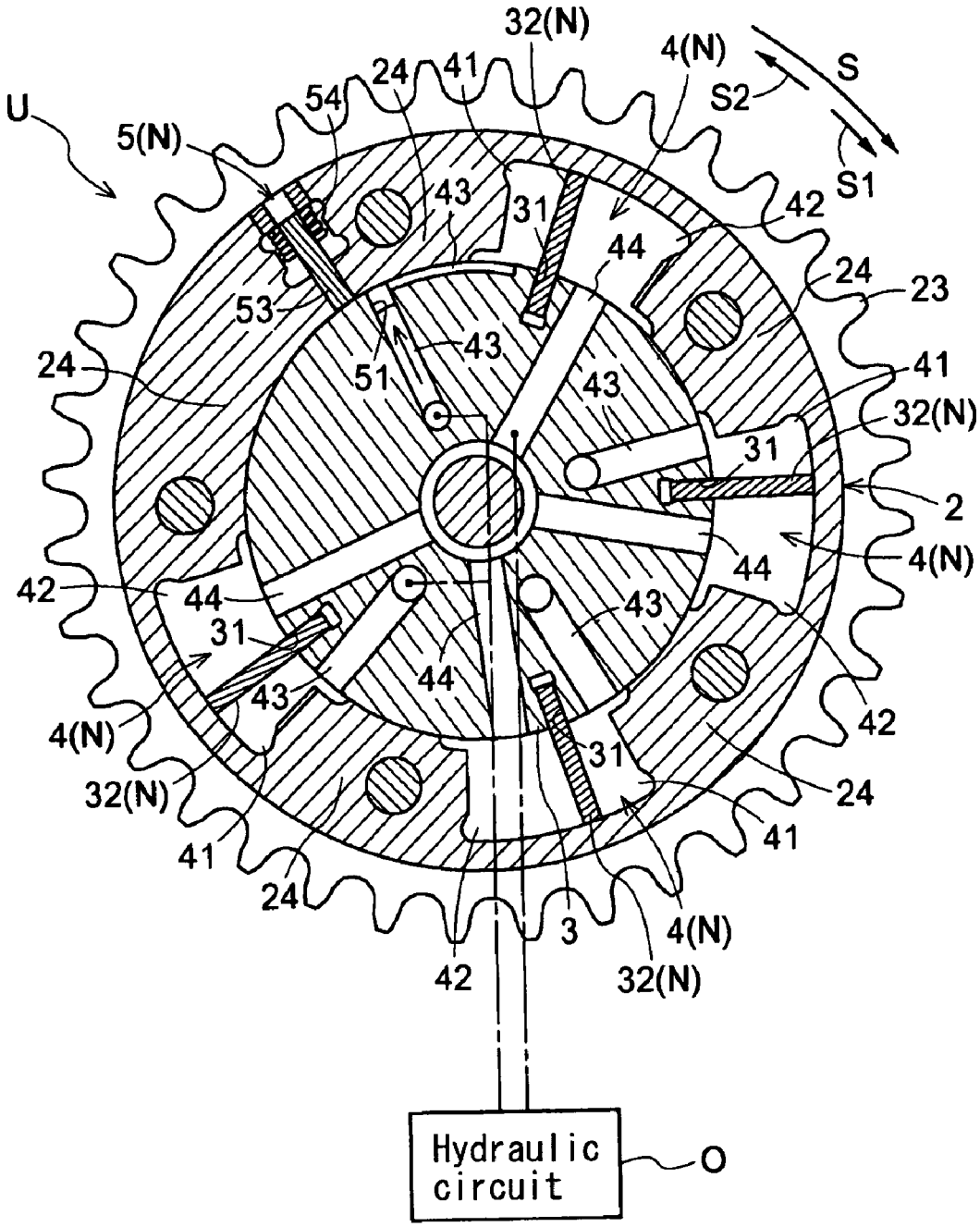
FIG. 7 is similar to FIG. 6, but showing still another condition of the phase control unit.
Figure 8:
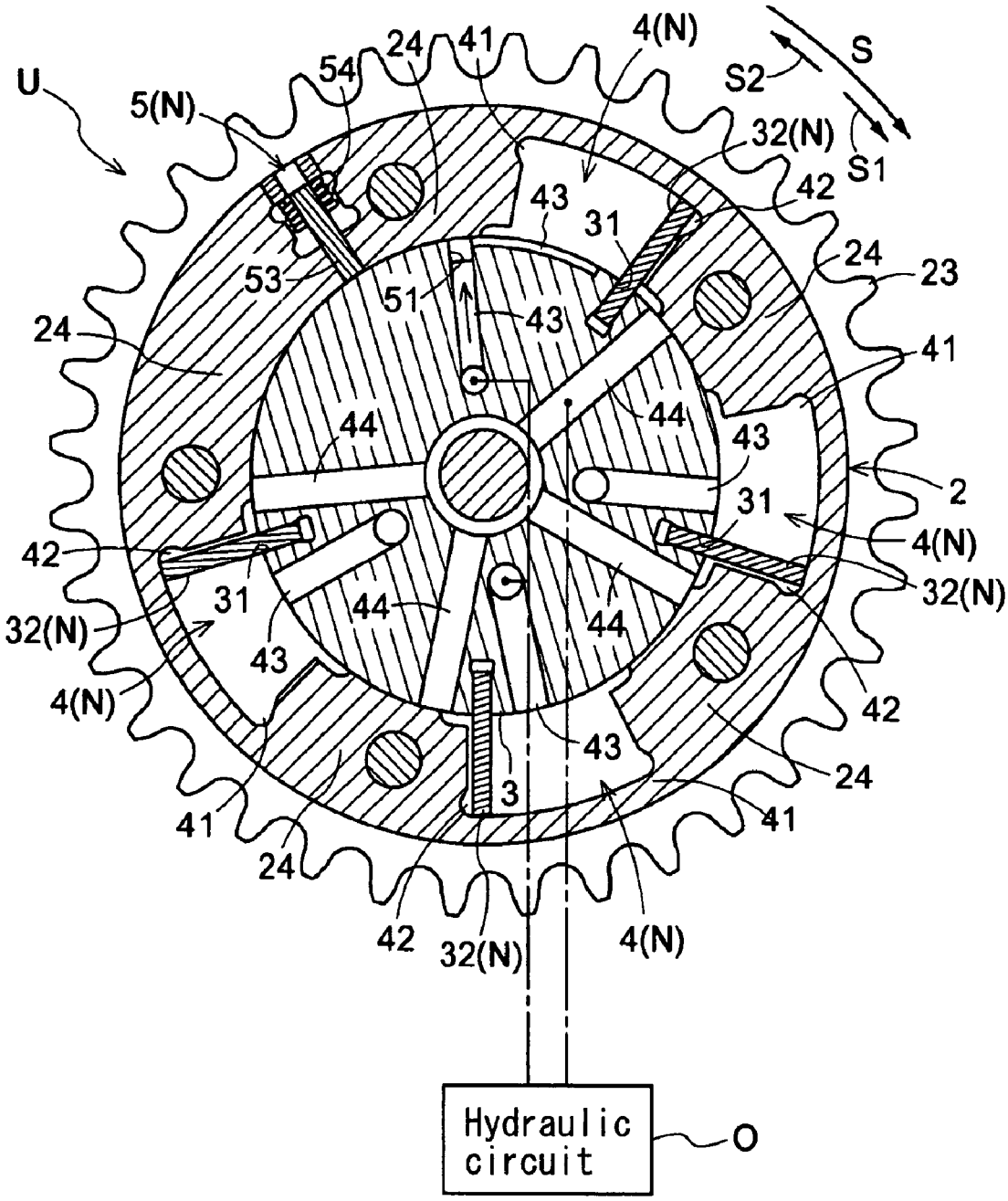
FIG. 8 is similar to FIG. 7, but showing further condition of the phase control unit.

The relative rotational phase between the inner and the outer rotors 3 and 2 is locked by the lock mechanism 5 when the engine E is stopped and the operation fluid is not supplied to the phase control unit U as shown in FIG. 5. The phase control unit U restrains the intake side camshaft 12*a* to its lock phase position (the most retarded angle phase) when the engine E is stopped. When the operation fluid is supplied to the advance angle passage 43 from the hydraulic circuit O, as shown in FIG. 6, the lock mechanism 5 is released by the retraction of the lock member 53 from the engagement recess portion 51. The operation fluid is further supplied to the advance angle chamber 41 to displace the relative rotation phase in the direction S1 that is the advance angle direction. Thereafter the phase is displaceable at any position between the most retarded angle and the most advanced angle as shown in FIG. 7. The phase control unit U enables to displace the intake side camshaft 12*a* phase to any position between the most retarded angle and the most advanced angle. FIG. 8 shows the relative rotation phase to be at the most advanced angle phase.

The lock phase (in this embodiment, the most retarded angle phase) is preferably set to the phase where the valve closing timing of the intake valve 13*a* becomes the retarded angle side more than a predetermined angle relative to the intake lower dead point. Thus, the phase control unit U fixes the intake side camshaft 12*a* so that the intake valve closing timing becomes a phase at the retarded angle side more than a predetermined angle relative to the intake lower dead point when the engine E is stopped. In this embodiment, the lock phase is preferably set to the range that the intake valve closing timing is more than 40° and less than 300° in crank angle at the retard side relative to the intake lower dead point. Assuming the exhaust upper dead point being zero (0°), the range becomes more than 220° and less than 300° in crank angle. When the engine environment is relatively good for operation such as when the engine temperature is above a predetermined degree it is preferable to retard the lock phase near the boundary of the retard side where the engine start is possible, such as 90° retarded relative to the intake lower dead point. By setting the lock phase in the above method, at the engine cranking start timing for engine start, the intake side camshaft 12*a* becomes the phase at very retarded side more than the normal retard phase. In the engine E, the intake valve 13*a* becomes open at the front half of the engine piston Ep rising process from the intake lower dead point. The compression ratio at the compression upper dead point (ignition point) becomes very low (decompression condition). This can minimize the vibration generated at the engine E immediately after the cranking started. ∝4. Structure of Hydraulic Circuit O The hydraulic circuit O will be explained hereinafter. The hydraulic circuit O includes a first pump P1 driven by the engine for supplying the operation fluid, and a second pump P2 driven by a motor M for supplying the operation fluid. The second pump P2 is provided at the downstream of the first pump P1. A reservoir R is provided in a flow passage between the first and second pumps P1 and P2 for reserving the operation fluid therein. In this embodiment, the reservoir tank R corresponds to the fluid reserving means. The hydraulic circuit O includes a first control valve V1 for controlling the supply of operation fluid to the first phase control unit U1, a second control valve V2 for controlling the supply of operation fluid to the second phase control unit U2. The first and the second control valves V1 and V2 control the supply of operation fluid to the hydraulic chamber 4 and the lock mechanism 5 forming the phase control mechanism N of each phase control unit U1 and U2.

The first pump P1 is a mechanical type hydraulic pump driven by the drive force of the crankshaft of the engine E. This first pump P1 suctions operation fluid reserved in the oil pan 61 from the inlet port and ejects the operation fluid to the downstream side from the outlet port. The outlet port of the first pump P1 is connected to the engine lubrication system EL, reservoir tank R and the second control valve V2 through the filter 62. The engine lubrication system EL includes all parts necessary for supplying the operation fluid in the engine E and its surroundings. The reservoir tank R is connected to the first control valve V1 through a bypass passage 63. The first pump P1 supplies the operation fluid to the first phase control unit U1 via reservoir tank R, bypass passage 63 and the first control valve V1 and at the same time supplies the operation fluid to the second phase control unit U2 via the second control valve V2.

On the other hand, the second pump P2 is an electric pump operated by the motor M. The second pump P2 is operated according to operation signals from the control device ECU regardless of the engine E condition. The second pump P2 suctions operation fluid from the reservoir tank R at the inlet port and ejects the operation fluid to the downstream side from the outlet port. The outlet port of the second pump P2 is connected to the first control valve V1. Accordingly, the second pump P2 supplies the operation fluid only to the first phase control unit U1 provided at the intake side camshaft 12*a* of the left side bank Eb1 through the first control valve V1. The second pump P2 is designed to have a proper ejection amount according to the viscosity of the operation fluid at the possible lowest temperature at the start of the engine. The temperature of the operation fluid can be set to, for example, −25° C. To meet with such high viscosity of the operation fluid, the rotation of the output shaft of the motor M can be reduced to rotate the rotor with a large torque and with a low rotation speed. The clearance between the rotor and the housing can be set to be large. Thus the operation fluid can be supplied to the first phase control unit U1 even when the operation fluid has a high viscosity at the low temperature when the engine is started.

The bypass passage 63 is provided in the hydraulic circuit O in parallel with the second pump P2 for communication between the upstream side and the downstream side of the second pump P2. A check valve 63*a* (one way valve) is provided in the bypass passage 63 to prevent an inadvertent reverse flow of the ejected operation fluid from the second pump P2 to the reservoir tank side through the bypass passage during the second pump P2 being operated. The operation fluid ejected from the first pump P1 is supplied to the first control valve V1 via the reservoir tank R and the bypass passage 63 when the first pump P1 is operated.

The reservoir tank R is provided between the first pump P1 and the second pump P2 for reserving a constant amount of fluid in a reservoir chamber Ra. The reservoir tank R includes a first communication port Rb for connecting the reservoir chamber Ra to the downstream side of the first pump P1, a second communication port Rc provided at the lower level than the first communication port Rb and connecting the reservoir chamber Ra to the upstream side of the second pump P2 and a lubrication system port Rd provided at the higher level than the first communication port Rb for connecting the reservoir chamber Ra to the engine lubrication system EL. The amount of reserved fluid in the reservoir chamber Ra includes a range lower than the location of the first communication port Rb and higher than the position of the second communication port Rc. The reservoir chamber reserves the fluid amount more than the amount necessary for supplying the operation fluid to the first phase control unit U1 from the second pump P2 under the first pump P1 being stopped condition. According to the embodiment, the second pump P2 supplies the operation fluid to the phase control mechanism N of the first phase control unit U1 under the first pump P1 being stopped and the ejection amount being insufficient. Accordingly, the required reserving amount of operation fluid in the reservoir chamber Ra of the reservoir tank R can be reduced by shortening the fluid flow passage between the second pump P2 and the first phase control unit U1 by arranging the second pump P2 close to the location of the first phase control unit U1.

The engine lubrication system EL, with which the lubrication system port Rd of the reservoir tank R, is exposed to the atmosphere and includes a flow resistance against the operation fluid flow. It is desirable to set the flow resistance of the lubrication system EL such that the operation fluid ejected from the first pump P1 is filled in the reservoir chamber Ra and a sufficient fluid pressure can be supplied to the hydraulic chamber 4 via the bypass passage 63 when the first pump P1 is operated and the second pump P2 is not operated. For example, when the second pump P2 is not operated and that the engine E is running with 200 rpm, the flow resistance in the reservoir chamber Ra is preferably the pressure level of 100 to 400 kPa. The lubrication system EL includes the main gallery portion of the engine E, chain tensioner portion and the piston jet portion.

Figure 9A:
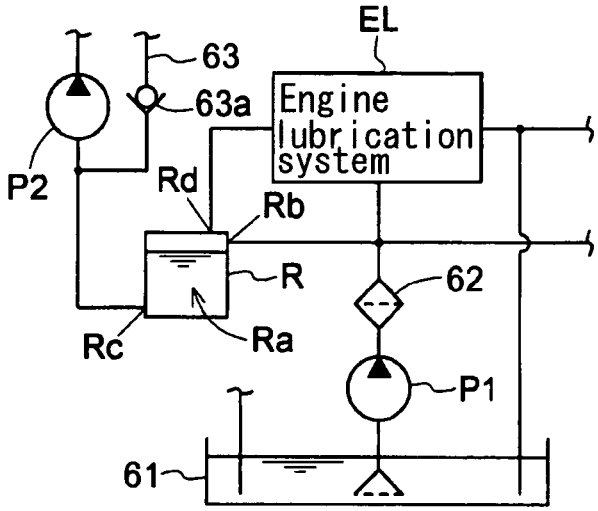
FIG. 9A to FIG. 9C, each is an explanation view showing an operation fluid condition in the reservoir tank according to the invention.
Figure 9B:
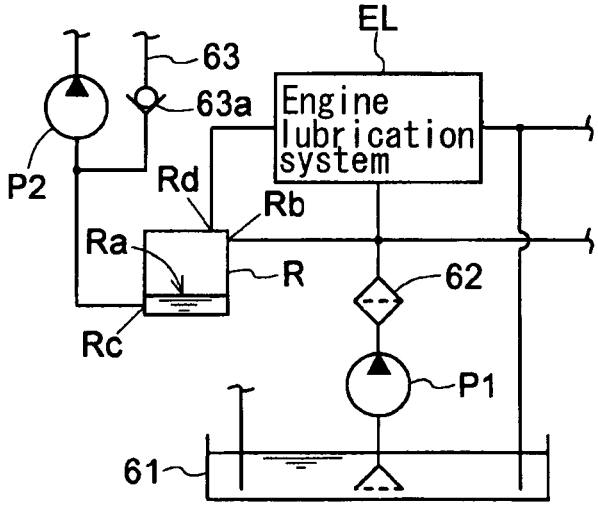
Figure 9C:
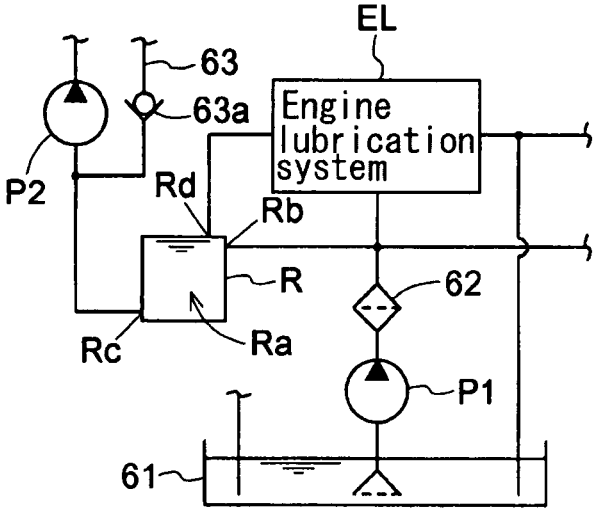

FIG. 9A to FIG. 9C show the operation fluid conditions of the reservoir tank R according to the various states of the engine E. FIG. 9A shows a condition of the operation fluid when the engine E is stopped (not operated). The operation fluid is not supplied to the first pump P1 under this condition. Since the engine lubrication system EL and the first pump P1 are exposed to the atmosphere, the operation fluid flows out from the lubrication system port Rd and the first communication port Rb and the air is introduced into the reservoir chamber Ra. On the other hand, the second pump P2 and the check valve 63*a* are sealed and there is no fluid flow there, the pressure level of which is lower than the first communication port Rb. Accordingly, the effective amount of the operation fluid in the reservoir tank R at the time of engine stopping is lower than the first communication port Rb and higher than the second communication port Rc.

The first pump P1 is stopped or the ejected amount of the operation fluid is not sufficient to be operated when the engine is just started. In such condition, the second pump P2 is operated to supply the operation fluid to the phase control mechanism N of the first phase control unit U1 as shown in FIG. 9B, the operation fluid in the reservoir chamber Ra of the reservoir tank R is suctioned to the second pump P2 thereby to reduce the amount of the fluid. The lubrication system EL, with which the lubrication communication port Rd is connected, is exposed to the atmosphere and the air may be introduced from the lubrication system communication port Rd via the engine lubrication system EL. Accordingly, the suction resistance of the operation fluid by the second pump P2 becomes small to operate the second pump properly even when the viscosity is high due to the low temperature of the fluid.

On the other hand, after the engine has started and the rotational speed (rpm) has risen, sufficient amount of operation fluid is ejected from the first pump P1. As shown in FIG. 9C, the reservoir chamber Ra is filled with the operation fluid. Since the engine lubrication system EL is exposed to the atmosphere, the air in the reservoir chamber Ra has been discharged via the engine lubrication system EL. As the engine lubrication system EL has some flow resistance, the pressure of the operation fluid in the reservoir chamber Ra is kept constant after the chamber Ra is filled with the operation fluid. Thus even when the second pump P2 is stopped, sufficient pressure can be supplied to the first phase control unit U1 of the phase control unit N via the bypass passage 63. It should be noted that when the engine rotation speed is low and the first pump P1 cannot make a sufficient pressure supply, the second pump P2 can be also operated to supply sufficient pressure for compensation. After the engine E is stopped and the second pump P2 is also stopped, the operation fluid in the reservoir chamber Ra returns to the condition as shown in FIG. 9A.

As the first and the second control valves V1 and V2, a variable electromagnetic spool valve can be used. A spool of the valve is slidably disposed in a sleeve and is displaced by overcoming the force of spring when the solenoid is excited by the control device ECU. The first control valve V1 includes an advance angle port in communication with the advance angle passage 43, a retard angle port in communication with the retard angle passage 44, a supply port in communication with the flow passage at downstream of the second pump P2 and a drain port in communication with an oil pan 61. The second control valve V2 includes an advance angle port in communication with the advance angle passage 43, a retard angle port in communication with the retard angle passage 44, a supply port in communication with the flow passage at downstream of the first pump P1 and a drain port in communication with the oil pan 61. The first and the second control valves V1 and V2 form the three position control valve which enables the three position control consisting of an advance angle control by connecting the advance angle port with the supply port and connecting the retard angle port with the drain port, a retard angle control by connecting the retard angle port with the supply port and connecting the advance angle port with the drain port and a hold control by closing the advance angle port and the retard angle port. The first valve V1 and the second valve V2 respectively form the first phase control unit U1 and the second phase control unit U2 under the control of the control device ECU. Thus, the first and the second valves V1 and V2 perform the switching over operation of the lock mechanism 5 between the lock condition and the released condition (unlocked condition) and the controlling of the relative rotational phase between the inner rotor 3 and the outer rotor 2 (phase of intake side camshaft 12*a*).

The control device ECU operates the second pump P2 and the first and the second valves V1 and V2. In detail, the ECU controls motor rotational speed and/or rotational torque for driving the second pump P2 and controls position of the spool of the first and the second valves V1 and V2. The ECU controls the second pump P2 to supply operation fluid from the cranking starting to the completion of the combustion at the engine starting. According to the embodiment, the control device ECU supplies operation fluid by operating the second pump P2 when the temperature of the fluid is less than or equal to the predetermined threshold value (for example, −10° C.) based on the temperature detection signal from the fluid temperature sensor SO which detects the temperature of the operation fluid to be supplied to the phase control unit U. In this embodiment, the sensor SO is structured to detect the fluid (oil) temperature in the oil pan 61. However, the temperature of the fluid may be detected at any position in the flow path. The control device ECU in this embodiment controls the first and the second valves V1 and V2 such that the phase of the first phase control unit U1 becomes the same phase of the second phase control unit U2.

5. Operation of the Valve Timing Control Device 1

Figure 10:
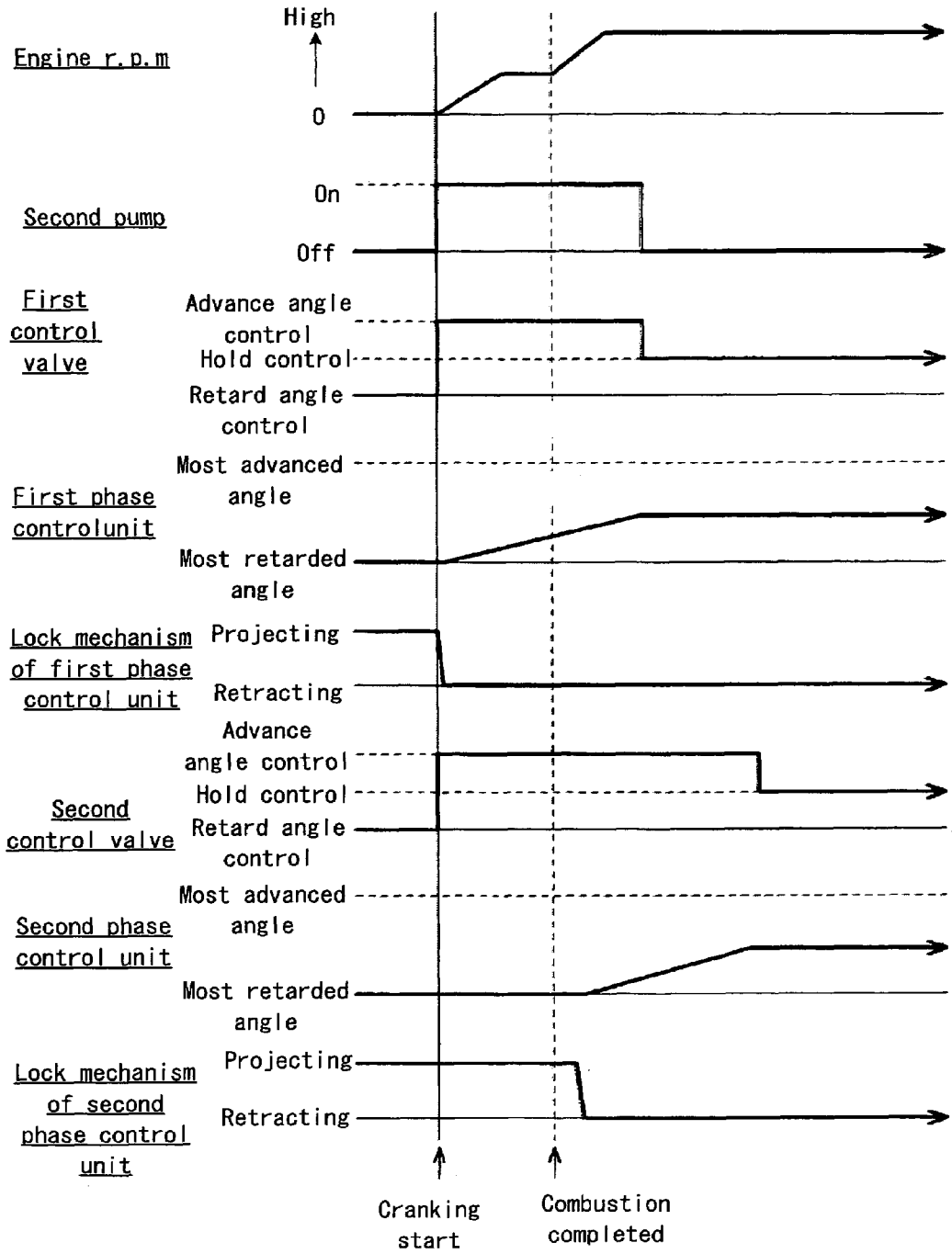
FIG. 10 is a timing chart showing an operation of the valve timing control device according to the invention; and, FIG. 11 is an explanation view showing an operation of the engine piston, an intake valve and a exhaust valve associated with the invention.

The operation of the valve timing control device 1 at the time of engine start based on the flowchart in FIG. 10 will be explained hereinafter. When it is difficult to start the engine, with the engine temperature being low and the relative rotational position of the phase control unit U being in the lock position (most retarded angle position), only the relative rotational phase of the first phase control unit U1 is shifted to the advance angle side by the operation fluid supplied to the second pump P2. First, the cylinder in the left bank Eb1 where the first phase control unit U1 is provided is completely combusted and thereafter the cylinder in the right side bank Eb2 is completely combusted. The operation of the valve timing control device 1 is explained in detail at the time when the second pump P2 is operated at the start of the engine under the condition that the temperature of the operation fluid to be detected by fluid temperature sensor SO is equal to or less than the operation threshold value.

Figure 11:
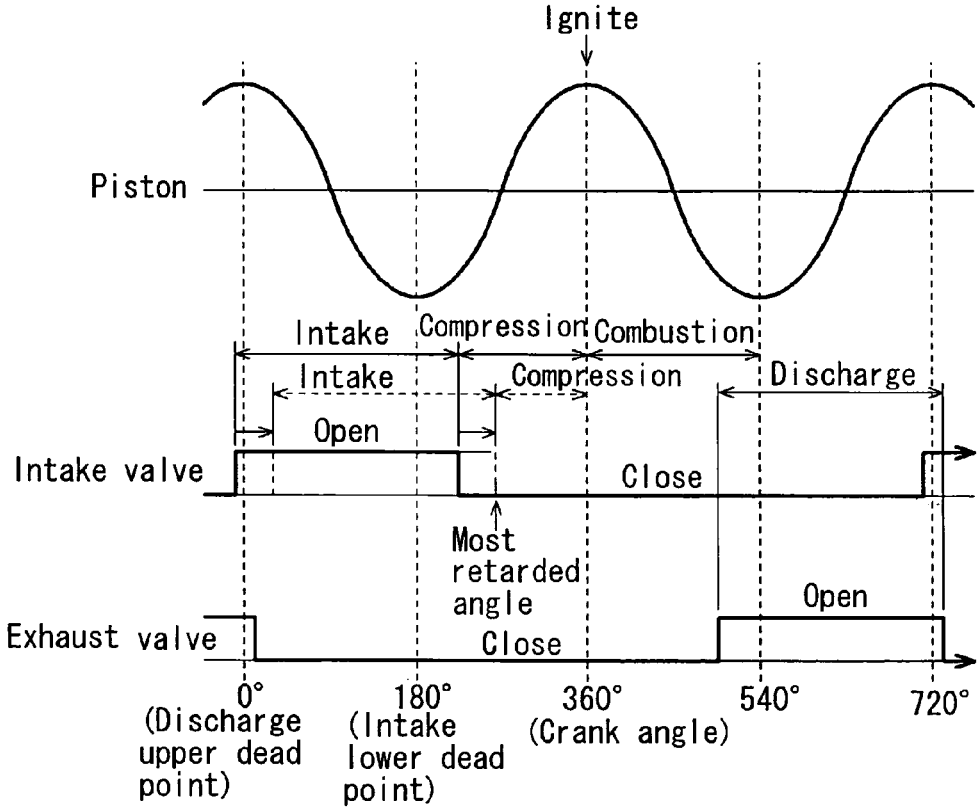
Figure 12:
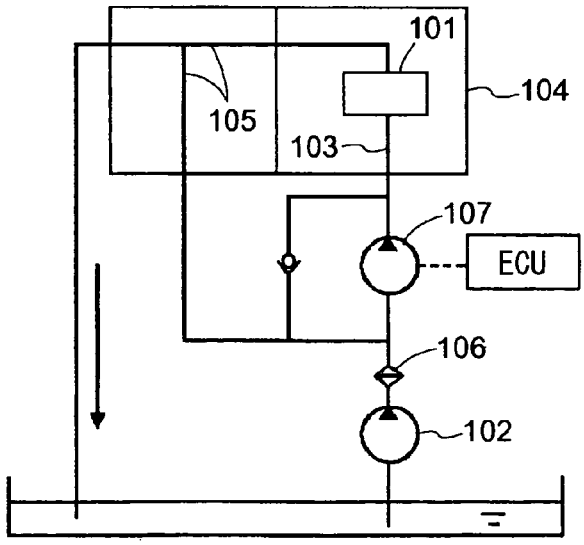
FIG. 12 Prior Art

First, when the engine is not operated, the first and the second pumps P1 and P2 are not operated. The relative phase of the first and the second phase control units U1 and U2 is in lock phase condition (most retarded angle phase) and the lock member 53 of the lock mechanism 5 is projected to have the system in locked position. As shown in this embodiment, the lock phase is set to a phase near the boundary of the retard side for engine starting (9° C. in retard side relative to the intake lower dead point). Accordingly, when the temperature of the engine E is relatively low, it would be difficult to start (complete combustion) even if the cranking is performed under the rotation phase of the first and the second phase control units U1 and U2 being in locked position. Under the lock phase (phase being locked condition), the intake side camshaft 12*a* positions farther retarded side than normal position and the valve closing timing of the intake valve 13*b* is retarded as shown in FIG. 11 indicated as "most retarded angle". The intake valve 13*a* opens in the first-half stage of piston Ep (FIG. 2) rising process from the intake lower dead point. Under this lock phase position, when the cranking operation is performed, the air in the cylinder is compressed to restrain the vibration of engine E.

When the cranking for starting the engine E, the control device ECU operates the second pump P2 (second pump ON) to start and at the same time the first and the second valves V1 and V2 become the advance angle control condition which enables to supply operation fluid to the advance angle chamber 41 of the phase control unit U and the engagement recess 51 of the lock mechanism 5. In the first phase control unit U1, the lock mechanism 5 becomes unlocking condition (as shown in FIG. 6) where the lock member 53 is retracted from the advance angle passage 43 towards the engagement recess 53 from the locking condition where the lock member 53 is projected into the engagement recess 53. After the lock mechanism 5 becomes unlocking condition, the relative rotational phase is shifted in the advance angle direction. Then the phase of the intake side camshaft 12*a* is shifted from the most retarded angle position in the advance angle direction during the cranking operation in the left side bank Eb1 in which the first phase control unit U1 is located. In other words, in the left side bank Eb1 cranking is performed with a higher compression ratio. Thus even when the engine temperature is low, in the left side bank Eb1, the engine is completely combustible at any phase timing during shifting in the advance angle side.

On the other hand, since the first pump P1 driven by the engine E has a low rotational speed (rpm) and insufficient ejection amount, not sufficient amount of operation fluid is supplied to the second phase control unit U2 and the second control valve V2 both of which do not receive any fluid supply from the second pump P2. Accordingly, the second phase control unit U2 is kept to be in locking condition to keep the relative rotational phase being bound to the lock phase (most retarded angle phase) even after the second valve V2 is shifted to the advanced angle condition. In the right bank Eb2 where the second phase control unit U2 is located, the intake side camshaft 12*a* is kept to the most retarded angle phase position during engine cranking operation. The cylinder of the right side bank Eb2 is kept to the decompression condition having smaller resistance by the piston Ep (FIG. 2) during engine cranking. This will reduce the operation resistance in the piston Ep in the right side bank Eb2 during cranking operation for completing the combustion in the right side bank Eb1 engine.

After the combustion completed in the left side bank Eb1 the engine rotation speed raises and the ejection amount of the operation fluid from the first pump P1 increases. Accordingly, the lock mechanism 5 in the second phase control unit U2 becomes unlocked condition to shift the relative rotational phase in the advance angle side. This will shift the phase of the intake side crankshaft 12*a* to the advance angle side from the most retarded angle side in the right side bank Eb2 and the engine is completely combusted in the right side bank Eb2 at any phase timing. On the other side, the second pump P2 is stopped its operation after the sufficient amount of ejected operation fluid is obtained by the first pump P1 by the increase of the engine rotation speed in the left side bank Eb1 by complete combustion. After the complete combustion in the right side bank Eb2, the control device ECU controls the first and the second valves V1 and V2 so that the relative rotational phase of the second phase control unit U2 becomes the same phase with the first phase control unit U1. After the both phases become identical or the same the control device ECU controls the first and the second valves V1 and V2 to shift the phases at any desired position in response to the engine operation condition by keeping the phases of the intake side camshafts 12*a*, 12*a* of both left side and right side banks EB1 and Eb2 to the same phase position. By controlling the valve timing control device 1, the engine can be quickly and assuredly started (complete combustion) even the engine type is the one that supplies operation fluid only to one of the phase control units of one bank (in this embodiment in the left side bank Eb1) by the electrically operated second pump P2.

ALTERNATIVE EMBODIMENTS OF THE INVENTION

The previous embodiment shows a phase control unit U at intake side camshaft 12*a* of the engine and no phase control unit is provided at exhaust side camshaft 12*b*. However the invention is not limited to this structure and another set of phase control unit can be provided at the exhaust side camshaft 12*b*.

According to the previous embodiment, the hydraulic circuit O includes a reservoir tank R provided in a flow passage between the first and the second pumps P1 and P2. However, the invention is not limited to this structure, for example, there is no reservoir tank between the pumps but instead the first and the second pumps may be provided in parallel to each other and the operation fluid may be supplied to the first valve from the respective pumps. For example, the second pump P2 suctions operation fluid directly from the oil pan 61 and the fluid passage at downstream of the first pump P1 is connected to the flow passage at the downstream of the second pump and upstream of the first control valve V1. The second pump P2 driven by the motor M can be placed in the vicinity of the intake side camshaft 12*a* in one of the engine banks and accordingly, the flow path from the second pump P2 to the phase control unit U can be shortened to restrain the ejection resistance from the second pump P2. This can minimize the size and quantity of the second pump and the motor.

According to the previous embodiment, the lock phase of the phase control unit U by the lock mechanism 5 is explained as the most retarded angle phase but the lock phase position can be chosen to any phase position other than the most retarded angle position as long as the relative rotational phase between the inner and outer rotors can be shifted.

The previous embodiment explains about the structure having the phase control unit U, which sets the locked phase for holding the intake side camshaft 12*a* to a phase, located at the vicinity of boundary of the retarded side. This setting in one of the examples of the invention and is not limited to this structure. The setting may be decided depending on the engine type and use conditions. It is preferable to set the lock phase at a retarded side a predetermined angle more than the intake lower dead point of the valve timing of the intake valve 12*a*. This setting can reduce the engine vibration by performing the decompression condition during the engine cranking.

According to the previous embodiment, the second pump is operated only when the temperature of the operation fluid is less than or equal to a predetermined temperature. However, it is possible to operate the second pump regardless of the temperature of the operation fluid.

The valve timing control device 1 is applied to the DOHC type engine in the previous embodiment. However, the invention can apply to the SOHC type engine. Also the invention can be applied to horizontally opposed type, W-type in addition to the V-type engine as long as the engine has a plural set of camshafts.

The principles, preferred embodiment and mode of operation of the present invention have been described in the foregoing specification. However, the invention is not to be construed as limited to the particular embodiment disclosed. Further, the embodiment described herein is to be regarded as illustrative rather than restrictive. Others may make variations and changes, and equivalents employed, without departing from the spirit of the present invention. Accordingly, it is expressly intended that all such variations, changes and equivalents that fall within the spirit and scope of the present invention as defined in the claims, be embraced thereby.

What we claim is:

1. A valve opening and closing timing control device, comprising;

a first phase control unit having a first drive side rotation member rotatable in synchronization with a crankshaft of an internal combustion engine, a first driven side rotation member provided coaxially with the first drive side rotation member and synchronously rotatable with a first camshaft that controls at least one of intake and exhaust valves at a first bank of the internal combustion engine, and a phase control mechanism for controlling a relative rotational phase between the first drive side rotation member and the first driven side rotation member by being supplied with operation fluid;

a second phase control unit having a second drive side rotation member rotatable in synchronization with the crankshaft of the internal combustion engine, a second driven side rotation member provided coaxially with the second drive side rotation member and synchronously rotatable with a second camshaft that controls at least one of intake and exhaust valves at a second bank of the internal combustion engine, and a second phase control mechanism for controlling a relative rotational phase between the second drive side rotation member and the second driven side rotation member by being supplied with the operation fluid;

a first pump driven by the internal combustion engine for supplying the operation fluid to both the first and second phase control units; and a second pump driven by a motor in such a manner that the second pump supplies the operation fluid inclusively to the first phase control unit without supplying the operation fluid to the second phase control unit while the first pump supplies the operation fluid to both the first and second phase control units.

2. The valve opening and closing timing control device according to claim 1, wherein the second pump supplies the operation fluid at least from a start of cranking of the engine to completion of combustion at the time of engine start.

3. The valve opening and closing timing control device according to claim 2, further including a fluid temperature detecting means for detecting a temperature of the operation fluid supplied to the first phase control unit, wherein the second pump supplies the operation fluid when the temperature of the operation fluid is equal to or more than a predetermined temperature.

4. The valve opening and closing timing control device according to claim 1, wherein the second pump is designed based on a viscosity of the operation fluid at the possible lowest temperature at the time of engine start.

5. The valve opening and closing timing control device according to claim 1,, wherein the second pump is provided in a flow passage at the downstream of the first pump and a reservoir means is provided in a flow passage between the first pump and the second pump for reserving the operation fluid therein.

6. The valve opening and closing timing control device according to claim 5, wherein the reservoir means includes a lubrication system communication port in communication with an engine lubrication system of the internal combustion engine at a position higher than a first communication port provided at the reservoir means and in communication with the first pump.

7. The valve opening and closing timing control device according to claim 6, wherein the reservoir means further includes a second communication port provided at a higher location than the first communication port and in communication with the second pump and wherein the quantity of the operation fluid in an area of the reservoir means lower than the first communication port and higher than the second communication port is equal to or more than the amount of the operation fluid to be supplied to the first phase control unit by the second pump when the operation of the first pump is stopped.

8. The valve opening and closing timing control device according to claim 5, further comprising a bypass passage for connecting the upstream side and downstream side of the second pump.

9. The valve opening and closing timing control device according to claim 1, wherein each of the first and second phase control units holds a camshaft angle for an intake valve at a phase that the intake valve closing timing becomes a retard angle side with an angle greater than or equal to a predetermined angle relative to a lower dead point of the intake valve.

10. A valve opening and closing timing control device comprising:

a plurality of phase control units, each of the phase control units being interposed between a crankshaft of an internal combustion engine and a corresponding cam shaft that controls at least one of intake and exhaust valves of the internal combustion engine, each of the phase control units being operated when supplied with an operation fluid, to adjust a rotational phase difference between the crankshaft and the corresponding cam shaft;

a first pump driven by the internal combustion engine for supplying the operation fluid to all of the plurality of phase control units; and a second pump driven by a motor to supply the operation fluid inclusively to only a selected one of the phase control units without supplying the operation fluid to any other of the plurality of phase control units while the first pump supplies the operation fluid to all of the plurality of phase control units.

* * * * *